US007303510B2

(12) United States Patent
Gebhardt

(10) Patent No.: US 7,303,510 B2
(45) Date of Patent: Dec. 4, 2007

(54) BICYCLE TRAINING APPARATUS

(76) Inventor: James Gebhardt, 1365 Carpenter Dr., Palatine, IL (US) 60074

( * ) Notice: Subject to any disclaimer, the term of this patent is extended or adjusted under 35 U.S.C. 154(b) by 213 days.

(21) Appl. No.: 11/174,154

(22) Filed: Jul. 1, 2005

(65) Prior Publication Data

US 2007/0004565 A1 Jan. 4, 2007

(51) Int. Cl.
*A63B 69/16* (2006.01)

(52) U.S. Cl. ..... 482/61; 482/5

(58) Field of Classification Search ..... 482/1, 482/3, 4, 5, 51, 57, 61; 601/36; 273/442; 434/61; 248/676; 211/1, 17, 20, 22, 23, 211/24, 175, 207

See application file for complete search history.

(56) References Cited

U.S. PATENT DOCUMENTS 4,077,607 A * 3/1978 Lovelady ..... 254/88
4,834,363 A 5/1989 Sargeant et al.
4,938,475 A 7/1990 Sargeant et al.
4,955,600 A 9/1990 Hoffenberg et al.
5,035,418 A * 7/1991 Harabayashi ..... 482/62
5,240,417 A * 8/1993 Smithson et al. ..... 434/61
5,354,251 A 10/1994 Sleamaker
5,364,271 A * 11/1994 Aknin et al. ..... 434/61
5,549,527 A 8/1996 Yu
5,645,513 A 7/1997 Haydocy et al.
5,785,630 A 7/1998 Bobick et al.
5,785,631 A 7/1998 Heidecke
5,890,995 A 4/1999 Bobick et al.
5,967,946 A * 10/1999 Beatty, Jr. ..... 482/61
6,056,672 A 5/2000 Carbonell Tendero
6,152,856 A 11/2000 Studor et al.
6,530,864 B1 3/2003 Parks
6,648,802 B2 11/2003 Ware
6,702,721 B2 3/2004 Schroeder
6,712,737 B1 * 3/2004 Nusbaum ..... 482/8
7,011,607 B2 * 3/2006 Kolda et al. ..... 482/57
7,226,395 B2 * 6/2007 Wu et al. ..... 482/57
2001/0003969 A1 * 6/2001 Miale et al. ..... 119/28.5

* cited by examiner

*Primary Examiner*—Ehud Gartenberg
*Assistant Examiner*—Oren I Ginsberg
(74) *Attorney, Agent, or Firm*—Jeffrey Sonnabend; SonnabendLaw

(57) ABSTRACT

A bicycle training apparatus having an elevator assembly, a wheel support assembly operatively coupled to the elevator assembly, and a resistance interface assembly operationally coupled to the elevator assembly. The elevator assembly operates to raise and lower the wheel support assembly, and the resistance interface assembly provides an output signal proportional to the height of the wheel support assembly.

23 Claims, 6 Drawing Sheets

BICYCLE TRAINING APPARATUS

BACKGROUND OF THE INVENTION

1. Field of the Invention

The present invention relates generally to devices for exercise, and more specifically to, devices for stationary bicycle training.

2. Background of the Related Art

Aerobic exercising apparatuses are well known in many forms which emulate real-world, non-stationary activities in a stationary manner. These include, among others, stationary exercising devices which emulate rowing, cycling, cross-country and downhill skiing, ice skating, walking, running, stair climbing, and rock climbing.

A wide variety of exercisers are known in the field of stationary bicycle exercisers. These include, among others, the devices disclosed in the following patents.

First, U.S. Pat. No. 4,834,363 to Sargeant, et al., entitled "Bicycle Racing Training Apparatus," discloses an exercising apparatus for supporting a bicycle. The apparatus includes a flywheel and variable load means connected to a roller in contact with the bicycle's rear wheel to simulate the inertia and variable load experienced by a rider during a real-world ride. U.S. Pat. No. 4,938,475, also to Sargeant, et al. and entitled "Bicycle Racing Training Apparatus", discloses, in addition to the apparatus disclosed in the previously discussed patent, means for varying the load applied from the variable load means to simulate real-world bicycle race conditions.

Next, U.S. Pat. No. 4,955,600 to Hoffenberg et al. and entitled "Bicycle Support and Load Mechanism" discloses an apparatus for receiving a bicycle to enable stationary exercise thereupon. The device includes a mechanism for applying differing loads to the rear wheel to simulate real world cycling conditions such as road incline, wind resistance, and tire to road friction. U.S. Pat. No. 6,702,721 to Schroeder, entitled "Bicycle Trainer with Movable Resistance Device" discloses a similar device.

In a like manner, U.S. Pat. No. 6,056,672 to Tendero, entitled "Training Apparatus for Cyclist and for Physical Exercise" discloses a device which receives a bicycle. The bicycle is positioned on a running belt and is constrained so as to permit lateral movement while restraining linear movement.

Somewhat similar to the foregoing is U.S. Pat. No. 6,648,802 to Ware, entitled "Variable Pitch Stationary Exercise Bicycle", which discloses a bicycle-like exercise apparatus which varies rear wheel resistance based on user controlled inclination or declination of the pseudo bicycle frame. U.S. Pat. No. 5,035,418 to Harabayashi and entitled "Cycle Type Athletic Equipment" also discloses a bicycle type exercise apparatus that tilts in a variety of orientations. U.S. Pat. No. 5,549,527 to Yu, entitled "Stationary Bike," likewise discloses a bicycle-like apparatus that alternates between an inclined and declined orientation to simulate uphill and downhill terrain. The device further includes a brake shoe which engages with a wheel to increase friction when the apparatus is in a simulated uphill orientation.

U.S. Pat. No. 5,240,417 to Smithson et al., entitled "System and Method for Bicycle Riding Simulation" discloses an interactive, computer controlled bicycle simulation arcade style game. The disclosed apparatus includes a simulated bicycle that includes front and rear wheels solely for visual appearance. A computer and user each partially controls the movement of the simulated bicycle in connection with an animated bicycle displayed on a screen. The computer controls the simulated bicycle in part to simulate changes in track terrain, including uphill and downhill gradations.

Similarly, U.S. Pat. No. 5,890,990 to Bobick et al., entitled "Interactive Exercise Apparatus" discloses a computer manipulated exercise device in which a computer controls various feedback components such as resistance to simulate a real world or artificial environment for an exerciser. The computer disclosed also updates a display of a virtual environment on a screen based on user inputs such as pedal speed and steering changes.

U.S. Pat. No. 5,785,631 to Heidecke, entitled "Exercise Device", discloses a bicycle-like apparatus that includes partial computer control over pedal resistance, as well as device orientation, so as to simulate inclined terrain and the like. The disclosed apparatus also may include a display device displaying simulated environments.

Still other exercise apparatuses simulate bicycling in a minimal manner. One such apparatus is disclosed in U.S. Pat. No. 5,354,251 to Sleamaker, entitled "Multifunction Exercise Machine with Ergometric Input-Responsive Resistance." The apparatus disclosed in this reference includes, among other configurations, a means for a user to exercise via pedals with resistance provided by the user's weight.

The foregoing devices have several shortcomings. For example, the several apparatuses discussed above that include simulated bicycles do not permit exercisers to use their own bicycles—a significant flaw for serious cyclists such as those involved in competitive cycling. These users generally desire to train on the same bicycle used in actual competition, not a different, simulated bicycle. Likewise, none of these apparatuses allow a user to mount his or her own bicycle in a device that simulates inclinations and declinations through varied bicycle orientation and cycling resistance proportional thereto. Furthermore, none permit a user to mount a bicycle into an apparatus that simulates real world conditions through video displays and the like.

With these considerations in mind, it is desirable to have an apparatus and method for using the same which permits serious cyclists to use

SUMMARY OF THE INVENTION

A bicycle training apparatus is disclosed having an elevator assembly, a wheel support assembly operatively coupled to the elevator assembly, and a resistance interface assembly operationally coupled to the elevator assembly. The elevator assembly operates to raise and lower the wheel support assembly, and the resistance interface assembly provides an output signal proportional to the height of the wheel support assembly.

The output signal may be a tension on a cable operatively attached to the resistance interface assembly, and the signal may be a decrease in tension of the cable proportional to an increase in height of the wheel support assembly.

The apparatus may include a linear bearing assembly operationally coupled to the wheel support assembly to provide support thereto. The apparatus may also include a linkage assembly operationally disposed between the elevator assembly and the resistance interface assembly such that the resistance interface assembly reacts to changes in the linkage assembly to provide an output signal proportional to the height of the wheel support assembly.

The apparatus may also include a linear actuator motor operationally coupled to the elevator assembly. The apparatus may also include a semi-automatic controller for controlling the linear actuator motor in accordance with a predefined sequence. Likewise, the apparatus may include a programmable controller for controlling the linear actuator motor to conform physical bicycle conditions substantially with a display of a virtual environment and/or to raise and lower the wheel support assembly in substantial synchronicity with a display of a virtual environment.

These and other aspects of the subject invention will become more readily apparent to those having ordinary skill in the art from the following detailed description of the invention taken in conjunction with the drawings described herein.

BRIEF DESCRIPTION OF THE DRAWINGS

So that those having ordinary skill in the art to which the subject invention pertains will more readily understand how to make and use the subject invention, preferred embodiments thereof will be described in detail herein with reference to the drawings.

DETAILED DESCRIPTION OF THE PREFERRED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. The various assemblies described herein each represents a particular embodiment of such assembly, and other embodiments of these assemblies, providing equivalent functionality, may be readily substituted.

Figure 1:
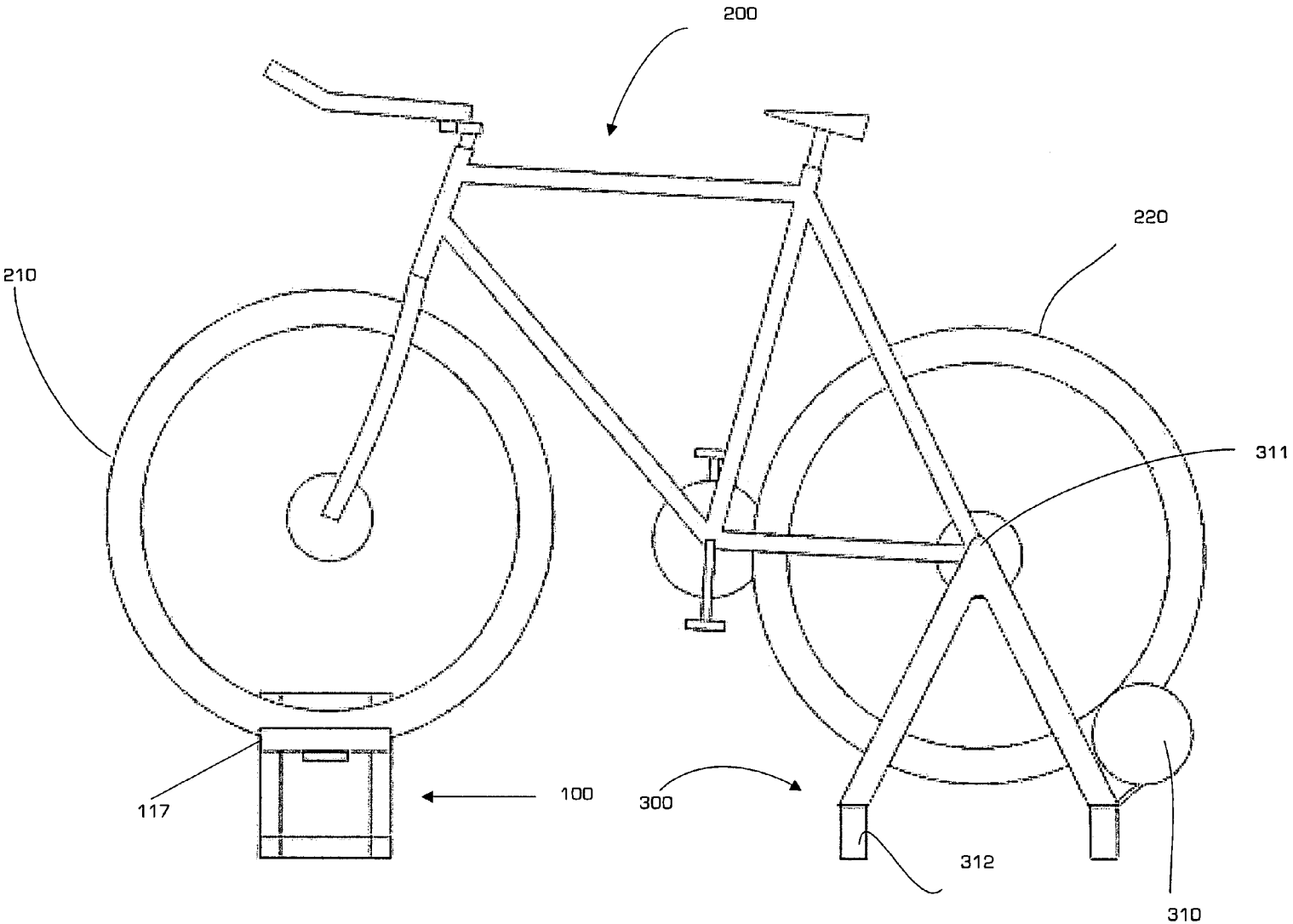
FIG. 1 is an elevational view of a preferred embodiment of the present invention, a trainer or trainer/support unit and a bicycle mounted therein.

Referring first to FIG. 1, bicycle 200 can be seen operationally mounted in a preferred embodiment of the present invention. Wheel platform 117 extends from frame 100 and supports front wheel 210 of bicycle 200. Frame 100 may be of extruded aluminum or any other material and/or fabrication method providing sufficiently rigid support. Alternatively, frame 100 may comprise a housing providing substantially similar functionality to frame 100, and the two may be considered functionally interchangeable and equivalent. Furthermore, frame 100 may include a covering (not shown) to hide and protect the assemblies contained therein and to provide an aesthetically pleasing appearance for the unit.

Rear wheel 220 is mounted in support unit 300 at axle clamp 311. Resistance unit 310 contacts rear wheel 220 substantially at its periphery and provides variable resistance to the free rotation of the wheel based on the input provided to it by an input cable, for instance, not shown, as will be readily understood by those of skill in the art. Support unit 300 and resistance unit 310 may be readily obtained as a unit, for example, as with the Minoura Mag 850 manufactured by the Minoura Company Limited (1197-1 Godo, Anpachi, Gifu, Japan), or the Computrainer Pro 3D, manufactured by RacerMate Inc. (3016 N.E. Blakeley Street Seattle, Wash.) or any other similar trainer or trainer/support unit combination with a remote capability. Elevation legs 312 may lift support unit 300 so that bicycle 200 is supported some distance above the ground when in its level orientation. In this manner, front bicycle 200 may be declined (i.e., placed in a "downhill" orientation) as well as inclined, as will be discussed in further detail below.

Support unit 300 may position rear wheel 220 at a sufficient elevation such that the instant invention may both incline and decline the bicycle, as will be discussed in further detail below.

Figure 2:
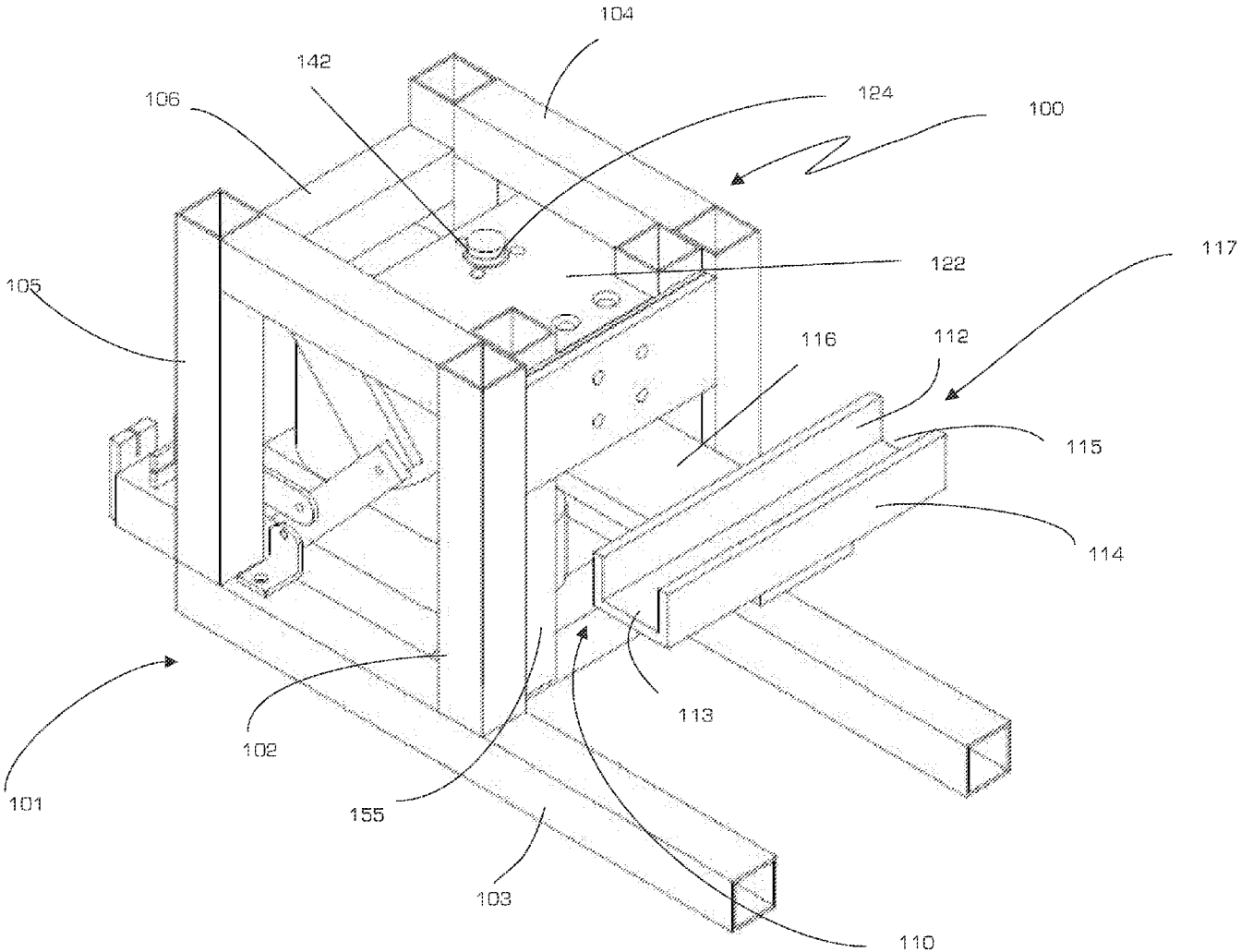
FIG. 2 is a perspective view of a preferred embodiment of the present invention.
Figure 3:
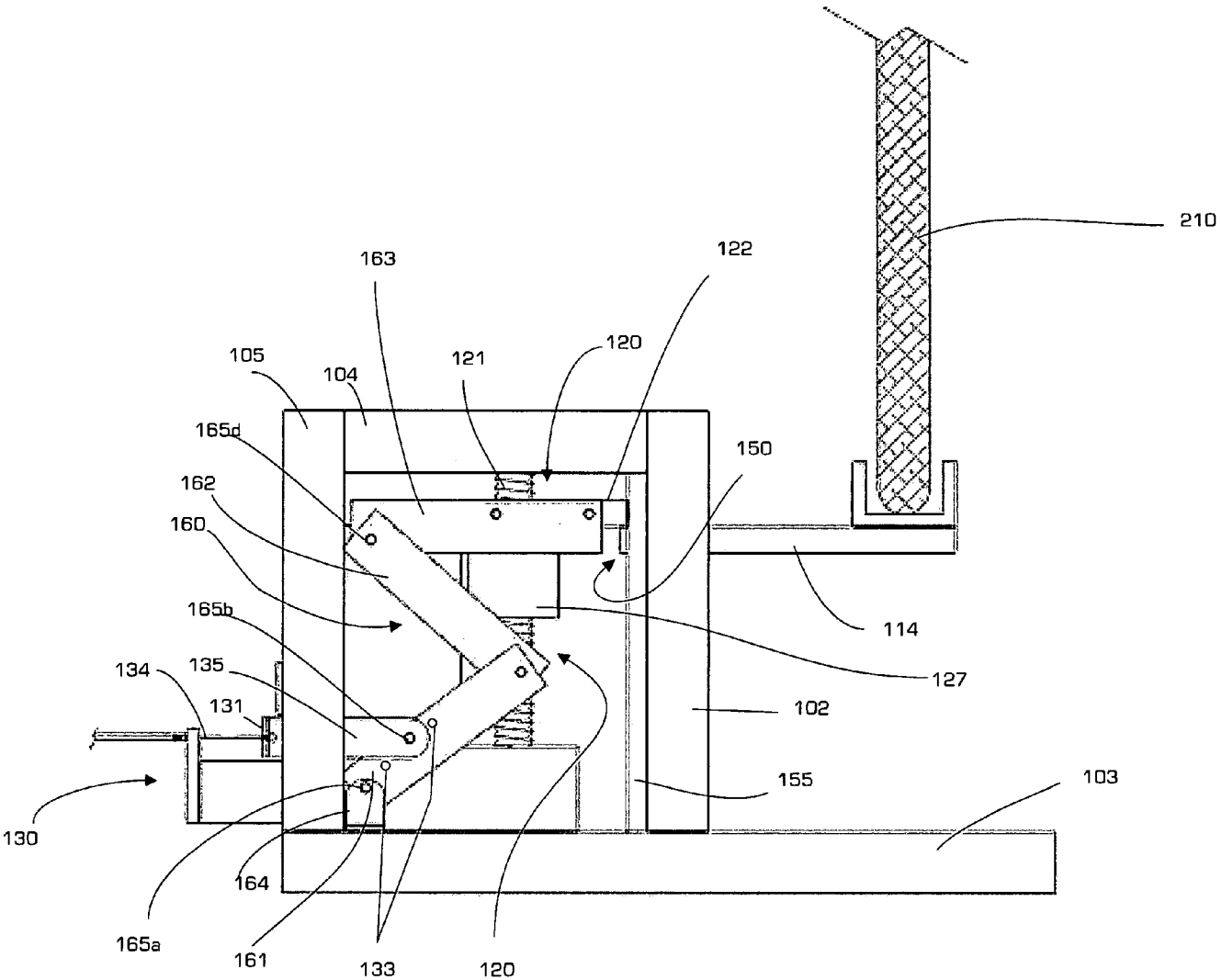
FIG. 3 is an elevational view of a preferred embodiment of the present invention, including a bicycle wheel mounted therein.
Figure 4:
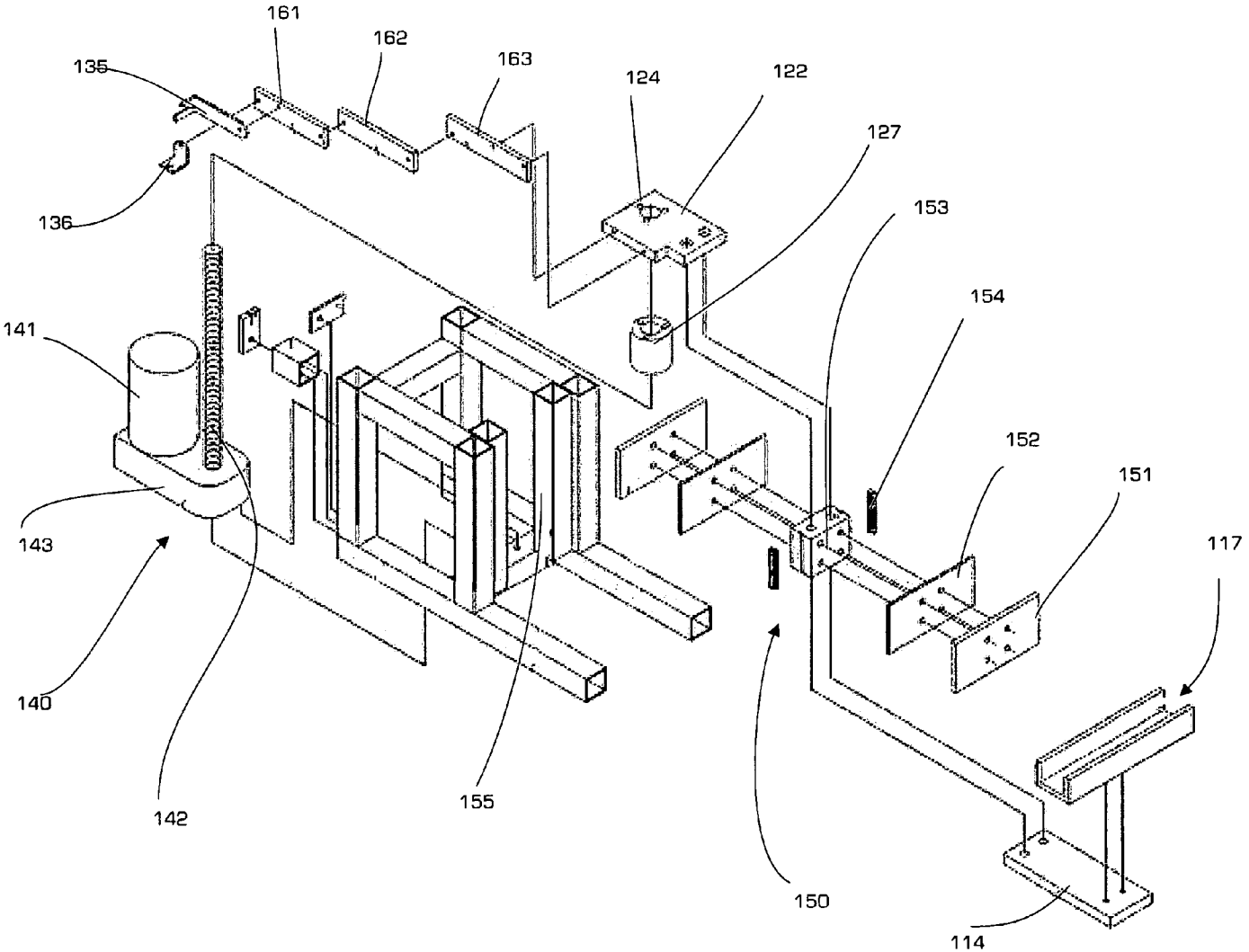
FIG. 4 is an exploded perspective view of a preferred embodiment of the present invention.
Figure 5:
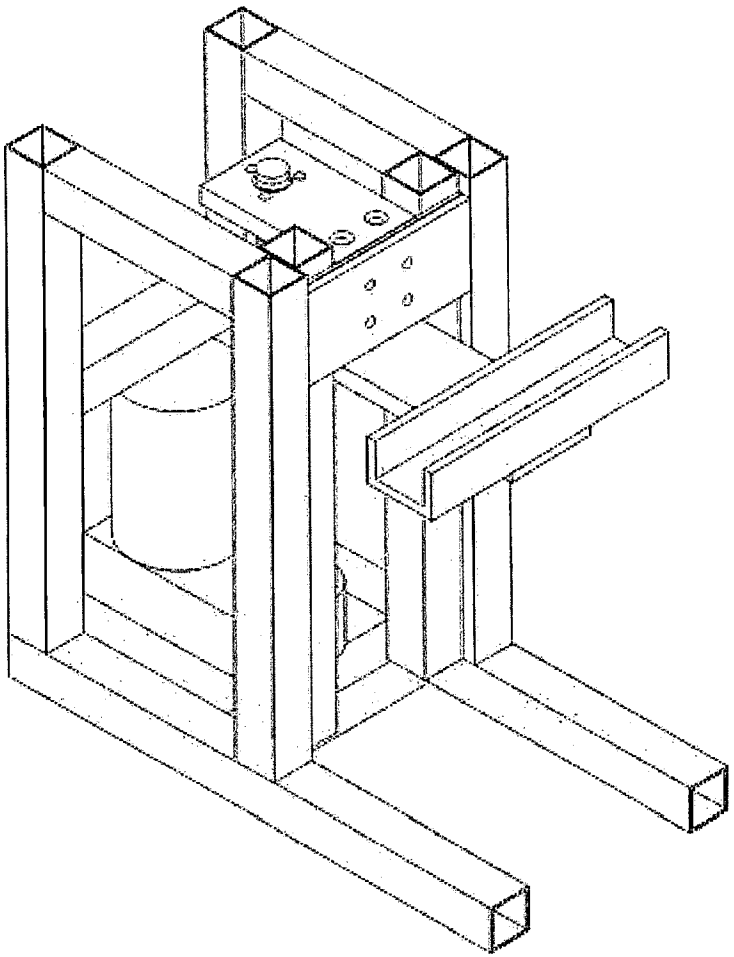
FIG. 5 is an elevational view of a second preferred embodiment of the present invention, including a bicycle wheel mounted therein.
Figure 6:
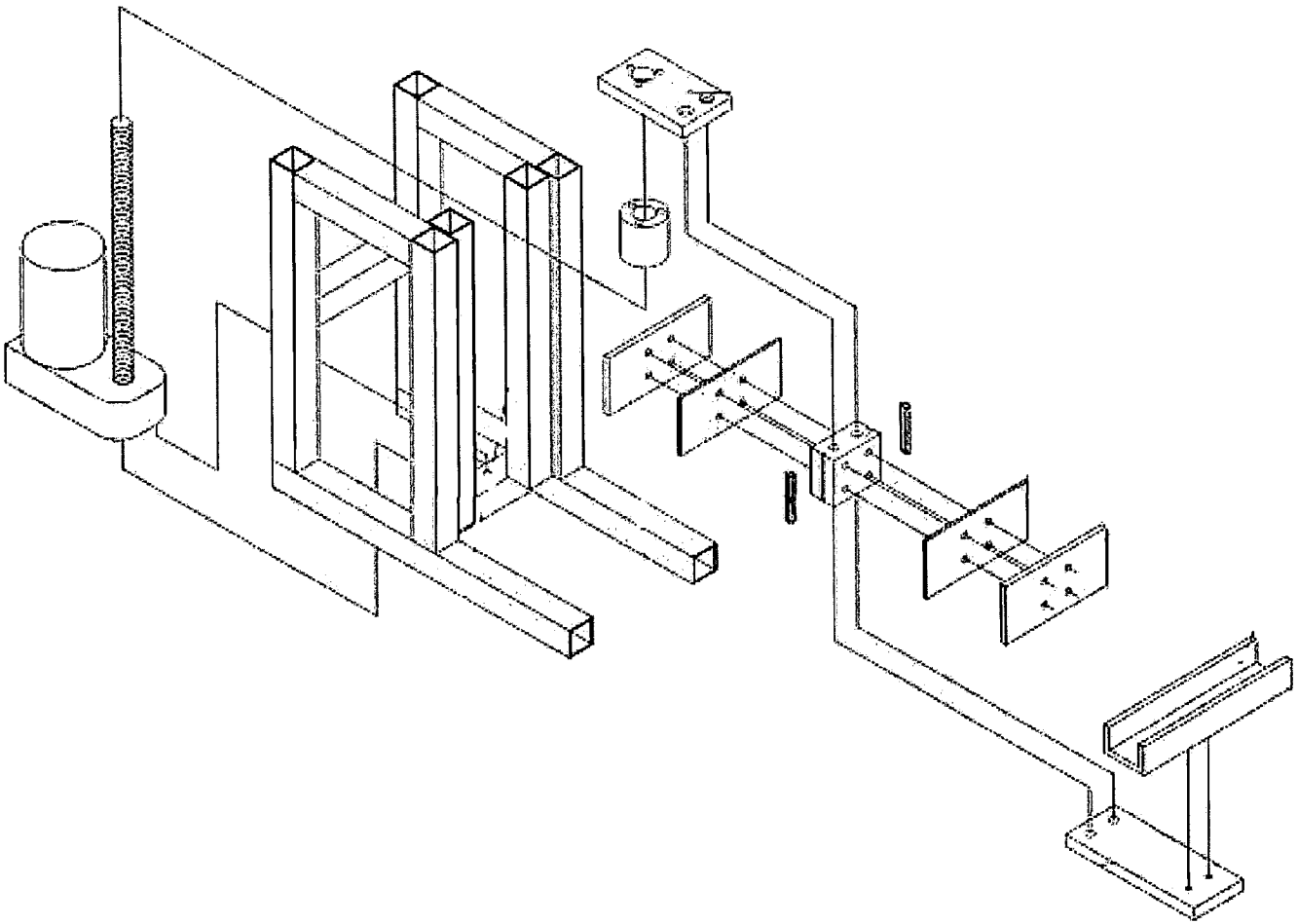
FIG. 6 is an exploded perspective view of a second preferred embodiment of the present invention.

Referring now to FIGS. 2 through 4, frame 100 provides overall structural support for the operational components of the present invention and provides a framework for transmission of forces from the bicycle/rider system to the surface on which the unit is placed.

Wheel platform 117 is adapted for accepting a front wheel of a bicycle and supporting it therein. In the instant embodiment, wheel platform 117 includes base 113 and sidewalls 112 and 114 extending perpendicularly therefrom. Tire channel 115 is formed between sidewalls 112 and 114. While an arrangement such as shown in FIG. 2 may be preferred, other wheel platform arrangements may also be utilized. For example, side walls 112 and 114 may be removed, or the wheel platform assembly may be curved instead of substantially orthogonal as shown, provided that the assembly adequately supports a bicycle wheel as discussed herein. Alternatively, the wheel platform may be adapted to accept a bicycle fork with wheel removed, for instance, by providing a fixedly attached cylinder approximating a wheel axle to be accepted by a bicycle fork. Collectively, wheel platform 117, base 113, sidewalls 112 and 114, tire channel 115, and elevation plate 116 comprise wheel support assembly 110.

Wheel platform 117 is operationally coupled to elevation plate 116 which in turn is coupled to linear bearing assembly 150, which is shown in exploded detail in FIG. 4, and thereby to drive plate 122 of elevator assembly 120. Bearing assembly 150 is comprised of a bearing block 153 disposed between two bearing pads 152 and bearing plates 151, with two bearings or sets of bearings 154 disposed in the ends of bearing block 153, as shown in FIG. 4. Bearings 153 travel in bearing channels 155 of frame 100. Bearings 153 may be of an acetal resin such as Delrin brand acetal resin manufactured by DuPont (1007 Market Street, Wilmington, Del.), and bearing assembly 150 may be any sufficiently strong assembly such as those from Bosch Rexroth Corp. (5150 Prairie Stone Parkway Hoffman Estates, Ill.) or other similar bearing assemblies. Bearing pads 152 may also be of a like acetal resin and may be ⅛" thick.

Elevator assembly 120 comprises drive plate 122 having aperture 124, and drive nut 127. Drive plate 122 functionally connects linear bearing assembly 150 to linear actuator assembly 140. Linear actuator assembly 140 is comprised of motor 141, lead screw 142, base 143, and transmission means between motor 141 and lead screw 142 (not shown). In operation, motor 141 rotates lead screw 142 via gear, pulley or other transmission means contained in base 143. Linear actuator motor 141 may be a Von Weise linear actuator model #V05583AX76U, manufactured by Fasco (402 E. Haven Street Eaton Rapids, Mich.) and others. Because drive nut 127 is fixedly attached to drive plate 122, which is constrained by linear bearing assembly 150 and/or frame 100 so as to prohibit rotational movement, as lead screw 142 rotates, drive nut 127 travels linearly along the length of lead screw 142, thereby raising and lowering drive plate 122. Drive plate 122 in turn raises and lowers elevation plate 116 and thus wheel platform 117.

The load applied to wheel platform 117 exerts a momentary force on linear bearing assembly 150 via elevation plate 116, which linear bearing assembly 150 transmits to frame 100, largely via vertical members 102, to base members 103, which in turn transmit the force to the surface on which the unit is placed. Base members 103 should extend a sufficient distance from vertical members 102, generally under wheel platform 117, so as to prevent the unit from tipping when a load is applied.

Elevator linkage 160 is comprised of several elements. First, base link member 165 is fixedly attached to frame 100 at any suitable point, for instance on base member 103 and/or rear vertical member 105. Lower linkage 161 is attached to base linkage at substantially the proximal end of lower linkage 161 by means of pin 165*a* such that lower linkage 161 is permitted to pivot about pin 165*a*. Lower linkage 161 is attached at substantially its distal end to the substantially proximal end or upper linkage 162 via pin 165*c* such that the linkages may rotate about pin 165*c*. Upper linkage 162 is attached at substantially its distal end to the substantially proximal end of drive plate bracket 163 via pin 165*d* such that upper linkage 162 may rotate about pin 165*d*. Drive plate bracket 163 is fixedly attached to drive plate 122, for example, at its periphery.

While elevator linkage 160 is shown in the present embodiment as having several substantially linear arm-like linkages, any linkage configuration which is capable of translating the height of the wheel platform and/or elevator assembly to the resistance unit interface may be utilized as a linkage assembly.

Resistance unit interface assembly 130, which provides an interface between a resistance unit and the present invention to transmit resistance information to such resistance unit, is operationally coupled to elevator assembly 120 via elevator linkage 160. The proximal end of cable 134, which may be knotted or be terminated in a ferrule or similar arrangement, or anchored in any other mechanically sound manner, is connected resistance cable linkage 135 at the linkage's proximal end by insertion into groove 121 formed in the proximal end of resistance cable linkage 135. The substantially distal end of resistance cable linkage 135 is coupled to lower linkage 161 by pin 165*b* such that resistance cable linkage 135 and lower linkage 161 may rotate about pin 165*b*. Multiple attachment points 133 in the form of apertures for receiving pin 165*b* may be provided in lower linkage 161 so as to allow fine tuning of the operation of cable 134 in connection with the unit.

In operation, when elevator assembly 120 moves upwardly or downwardly, as previously described, resistance cable linkage 135 follows the movement of lower linkage 161, altering the tension on cable 134 in proportion to the movement of lower linkage 161, which in turn moves in proportion to the raising and lowering of elevator assembly 120 and consequently wheel platform 117 and front wheel 210. Thus, as front wheel 210 is raised and bicycle 200 is inclined as previously described, the tension on cable 134 is reduced proportionally to the degree of wheel rise (and therefore bicycle incline). Because cable 134 controls the resistance applied to rear wheel 220 and therefore the resistance felt by the user when pedaling, the user experiences an increase in pedaling resistance proportional to the degree of incline, just as if the user were actually climbing a hill in the real world. Likewise, if the bicycle is positioned such that a the unit's lowest level of elevation (i.e., when the elevator assembly is at the lowest point of travel) the bicycle is declined (i.e., pointing "downhill"), the rider may experience minimum pedal resistance, as if the rider were traveling downhill in the real world.

While the preferred embodiment disclosed in the figures includes elevator linkage 160 operationally disposed between elevator assembly 120 and resistance cable assembly 130, other arrangements, such as direct attachment of the resistance cable linkage to the elevator assembly are possible without departing from the present invention.

Linear actuator 140, which controls the motion of elevator assembly 120, may be controlled through a variety of means. In certain embodiments, linear actuator 140 may be controlled directly by the user by means of electrical switches, buttons and the like, as will be readily appreciated by those of skill in the art. Electromechanical means may also be utilized.

In other embodiments, linear actuator 140 may be controlled by a semi-automatic controller, that is, a controller requiring limited user intervention, such as intervention to start or stop the controller or to select a particular program to govern operation of the controller, as discussed more fully below. For example, a timer circuit may be used to control an linear actuator 140 using a 120 VAC, 1.8A PSC motor with built in limit switches. Upon applying power to the timer circuit, from a switch mounted on a remote switch plate controlled by the user, the timer circuit may run sequentially through various timer segments constituting an exercise "program". A program may comprise multiple segments such as:

Timer Segment 1—Upon supplying power to the circuit, the actuator immediately starts and runs in the forward direction from 4-20 seconds;

Timer Segment 2—The actuator remains off from between 2 and 360 seconds;

Timer Segment 3—The actuator runs in reverse for 4-20 seconds; and

Timer Segment 4—The actuator remains off from between 2 and 360 seconds.

Low voltage solid state relays or triacs may be used to switch 120 VAC directly to provide a margin of safety for the user. Alternatively or additionally, a microprocessor and up to four potentiometers may be used to control these timing functions.

In still other embodiments, linear actuator 140 may be controlled by a programmable controller such as a computer or microprocessor based device, including among others the NetAthlon manufactured by FitCentric® Technologies, Inc. (9635 Monte Vista Ave, Suite 201, Montclair, Calif.) and the aforementioned Computrainer devices. Such controller may be adapted to synchronize visual cues, such as computer generated graphics depicting a simulated real world riding environment, as well as physical cues, such as pedaling resistance. In this embodiment, a control computer or similar device would send appropriate signals to linear actuator 140 to raise or lower front wheel 220 in synchronicity with visual displays, for example, to raise wheel 220 when a visual display depicted an uphill environment. Other environmental elements could be similarly controlled in this manner, such as fans to simulate wind conditions proportional to bicycle speed and/or ambient weather conditions.

In the foregoing embodiments, the programmable controllers are directly interfaced to the unit of the instant invention; however, other embodiments are also possible, for example, embodiments wherein the programmable controllers directly control the resistance unit. In this case, the unit of the present invention would adjust front wheel elevation in proportion to the resistance applied by the resistance unit, thus achieving the same experience for the rider as in the previously discussed embodiments.

While particular embodiments of the present invention have been shown and described, it will be apparent to those skilled in the pertinent art that changes and modifications may be made without departing from the invention in its broader aspects.

What is claimed is:

1. A bicycle training apparatus comprising an elevator assembly; a wheel support assembly operatively coupled to said elevator assembly; and a resistance interface assembly operationally coupled to said elevator assembly, wherein:

said elevator assembly operates to raise and lower said wheel support assembly; and said resistance interface assembly provides an output signal proportional to the height of said wheel support assembly.

2. The apparatus of claim 1, wherein said output signal is a tension on a cable operatively attached to said resistance interface assembly.

3. The apparatus of claim 2, wherein said signal comprises a decrease in tension of said cable proportional to an increase in height of said wheel support assembly.

4. The apparatus of claim 1, further comprising a linear bearing assembly operationally coupled to said wheel support assembly to provide support thereto.

5. The apparatus of claim 4, wherein said output signal is a tension on a cable operatively attached to said resistance interface assembly.

6. The apparatus of claim 5, wherein said signal comprises a decrease in tension of said cable proportional to an increase in height of said wheel support assembly.

7. The apparatus of claim 4, further comprising a linear actuator motor operatively coupled to said elevator assembly to raise and lower said elevator assembly.

8. The apparatus of claim 7, wherein said output signal is a tension on a cable operatively attached to said resistance interface assembly.

9. A bicycle training apparatus comprising: an elevator assembly; a wheel support assembly operatively coupled to said elevator assembly; a linkage assembly operationally coupled to said elevator assembly; and a resistance interface assembly operationally coupled to said linkage assembly, wherein:

said elevator assembly operates to raise and lower said wheel support assembly; and said resistance interface assembly reacts to changes in said linkage assembly to provide an output signal proportional to the height of said wheel support assembly.

10. The apparatus of claim 9, wherein said linkage assembly comprises a lower linkage and an upper linkage.

11. The apparatus of claim 10, wherein said resistance interface assembly is operatively attached to said lower linkage.

12. The apparatus of claim 11, wherein said output signal is a tension on a cable operatively attached to said resistance interface assembly.

13. The apparatus of claim 9, wherein said output signal is a tension on a cable operatively attached to said resistance interface assembly.

14. The apparatus of claim 13, wherein said signal comprises a decrease in tension of said cable proportional to an increase in height of said wheel support assembly.

15. The apparatus of claim 9, further comprising a linear bearing assembly operationally coupled to said wheel support assembly to provide support thereto.

16. The apparatus of claim 15, wherein said output signal is a tension on a cable operatively attached to said resistance interface assembly.

17. The apparatus of claim 16, wherein said signal comprises a decrease in tension of said cable proportional to an increase in height of said wheel support assembly.

18. The apparatus of claim 15, further comprising a linear actuator motor operatively coupled to said elevator assembly to raise and lower said elevator assembly.

19. The apparatus of claim 18, wherein said output signal is a tension on a cable operatively attached to said resistance interface assembly.

20. A bicycle training apparatus comprising an elevator assembly; a wheel support assembly operatively coupled to said elevator assembly; a resistance interface assembly operationally coupled to said elevator assembly; and a linear actuator motor operatively coupled to said elevator assembly, wherein:

said elevator assembly operates to raise and lower said wheel support assembly;

said linear actuator motor operates to raise and lower said elevator assembly; and said resistance interface assembly provides an output signal proportional to the height of said wheel support assembly.

21. The apparatus of claim 20, further comprising a controller for controlling said linear actuator motor to raise and lower said wheel support assembly in substantial synchronicity with a display of a virtual environment.

22. The apparatus of claim 20, further comprising a linkage assembly operationally coupled to said elevator assembly, said resistance interface assembly operationally coupled to said elevator assembly via said linkage assembly, wherein said resistance interface assembly reacts to changes in said linkage assembly to provide an output signal proportional to the height of said wheel support assembly.

23. The apparatus of claim 22, further comprising a programmable controller for controlling said linear actuator motor to raise and lower said wheel support assembly in substantial synchronicity with a display of a virtual environment.

* * * * *